US006295042B1

(12) United States Patent
Aoki

(10) Patent No.: US 6,295,042 B1
(45) **Date of Patent: *Sep. 25, 2001**

(54) DISPLAY APPARATUS

(75) Inventor: Tadashi Aoki, Kawasaki (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/869,508

(22) Filed: Jun. 5, 1997

(30) Foreign Application Priority Data

Jun. 5, 1996 (JP) ..... 8-143299
Jun. 26, 1996 (JP) ..... 8-166330

(51) Int. Cl.[7] ..... G09G 3/36
(52) U.S. Cl. ..... 345/94; 345/100; 345/208
(58) Field of Search ..... 345/87, 89, 94, 345/147, 173, 88, 98, 99, 100, 104, 204, 208; 341/22, 136; 348/13, 531; 455/2

(56) References Cited

U.S. PATENT DOCUMENTS 4,048,633 * 9/1977 Sano ..... 345/94
4,734,688 * 3/1988 Adams ..... 345/50
5,287,092 * 2/1994 Shiraishi ..... 345/55
5,307,084 * 4/1994 Yamaguchi et al. ..... 345/58
5,610,628 * 3/1997 Yamamoto et al. ..... 345/94
5,657,037 * 8/1997 Okada et al. ..... 345/94
5,892,504 * 4/1999 Knapp ..... 345/204

* cited by examiner

*Primary Examiner*—Almis R. Jankus
*Assistant Examiner*—Amr Awad
(74) *Attorney, Agent, or Firm*—Fitzpatrick, Cella, Harper & Scinto

(57) ABSTRACT

A display apparatus, such as a liquid crystal display apparatus, is constituted by: a display unit including electrodes arranged in a matrix form, a circuit for generating a signal waveform applied to the electrodes of the display unit, and a low-pass filter for removing a frequency component exceeding a prescribed frequency from the signal waveform to inlet ends of the electrodes in the display unit. As a result, the occurrence of a large transient current liable to flow at pixels close to inlet ends of the display unit can be suppressed. The removal of such a high-frequency component may also be performed by superposing split pulses with a resin and a falling portion of a drive signal waveform and by integrating the superposed drive signal waveform.

6 Claims, 12 Drawing Sheets

DISPLAY APPARATUS

FIELD OF THE INVENTION AND RELATED ART

The present invention relates to a display apparatus using a liquid crystal, an electrochromic material, an electroluminescent material, plasma, micromirrors, etc., particularly a display apparatus including a matrix electrode structure comprising a group of scanning electrodes and a group of data electrodes.

FIG. 11 is a schematic illustration of a display apparatus 16 having a matrix electrode structure. The display apparatus 16 includes a display panel 21 which in turn includes a matrix electrode structure composed of scanning electrodes 18 and data electrodes 19 intersecting the scanning electrodes 18. The scanning electrodes 18 are connected to a scanning signal application circuit 15, and the data electrodes 19 are connected to a data signal application circuit 17.

Ordinarily, the scanning signal application circuit 15 sequentially selects one scanning electrode and supplies a scanning selection signal thereto at a time while simultaneously supplying a scanning non-selection signal to the remaining scanning electrodes. On the other hand, the data signal application circuit 17 supplies to the data electrodes with data signals for determining display states of respective pixels each formed at each intersection of the scanning electrodes and the data electrodes in synchronism with the scanning selection signal.

Hereinbelow, an example description will be presented regarding a liquid crystal display apparatus.

In a liquid crystal apparatus including a liquid crystal display unit (liquid crystal display panel) 21 including a matrix electrode structure as shown in FIG. 11, the liquid crystal at each pixel is directly driven by a drive signal waveform applied to associated electrodes 18 and 19 in a display panel 21 from a scanning signal application circuit 15 and a data signal application circuit 17 inclusively represented as a drive circuit 20 (which more appropriately represents a scanning signal application circuit 15) as shown in FIG. 12. Now, a drive signal waveform applied to a drive circuit-side end as represented by a point A in FIG. 12 of an electrode (18) in the display panel 21 is a rising rectangular wave as shown at WFA in FIG. 13. Such a rectangular wave may be regarded as a waveform having a high-frequency component at the rising portion.

Incidentally, one electrode (18) in a liquid crystal display panel 21 may be represented by an equivalent circuit comprising a number of resistances R each representing a resistance per unit length and a number of load resistances C each representing a load resistance per unit length. A circuit as represented by such an equivalent circuit may be regarded as having an impedance $Z_0$ calculated by the following equation:

$$Z_0 = \frac{R}{2} + \sqrt{\frac{R^2}{4} + \frac{R}{2\pi f C}}$$

The transfer ratio A is calculated by the following equation:

$$A = 1 - \frac{R}{\frac{R}{2} + \sqrt{\frac{R^2}{4} + \frac{R}{2\pi f C}}}$$

Accordingly, an electrode of the liquid crystal display panel may be regarded as having a frequency characteristic of transfer ratio (a frequency-dependent transfer ratio) as shown in FIG. 15 and may be regarded as equivalent to a low-pass filter having a cut-off frequency (=¼πRC) determined by C and R.

When each electrode of the liquid crystal display panel 21 having such a frequency characteristic is supplied with a drive signal for direct driving having a frequency component exceeding the cut-off frequency, the frequency component exceeding the cut-off frequency is gradually attenuated the further away the drive signal is from the input terminal, so that only a frequency component below the cut-off frequency (=¼πRC shown in FIG. 15) required for display a picture or a character is transmitted to an opposite (or remote) end of the electrode in the liquid crystal display panel.

As a result, a drive signal waveform applied to a remote terminal of the electrode as represented by a point B in FIG. 12 becomes a "dull" drive signal waveform from which a frequency component exceeding the cut-off frequency has been removed as shown at WFB in FIG. 13. Such a waveform may also be called a "slowly rising waveform".

However, in a liquid crystal apparatus including a liquid crystal display panel to be driven for display operation by application of a drive signal waveform, in case where a rectangular drive signal waveform regarded as including a frequency component exceeding the cut-off frequency at its rising portion and falling portion is applied to an electrode of a liquid crystal display panel for driving, a transient large current TCA (FIG. 13) is flowed at the time of falling and rising of the rectangular wave due to a frequency component exceeding the cut-off frequency contained in the rising or falling portion of the rectangular wave.

Such a transient large current is liable to cause difficulties, such as a fluctuation in power supply potential or ground potential of the liquid crystal apparatus, occurrence of radiation noise, heat-generation at the liquid crystal display panel, and an increase of current consumption.

According to the inventor's knowledge, such a phenomenon can be practically free of problems in cases where the display panel is small in size, but can cause difficulties, leading to a lower reliability, such as a malfunction of the apparatus and a lower picture display quality, in a case of a high-definition and large-size display panel of 38 cm or larger in diagonal size having 1280×1024 or more pixels.

SUMMARY OF THE INVENTION

Accordingly, a principal object of the present invention is to provide a display apparatus wherein a drive signal waveform having a frequency component below a prescribed frequency can be selectively applied to electrodes in the display unit.

According to the present invention, there is provided a display apparatus, comprising:

- a display unit including electrodes arranged in a matrix form,
- a circuit for generating a signal waveform applied to the electrodes of the display unit, and a low-pass filter for removing a frequency component exceeding a prescribed frequency from the signal waveform to inlet ends of the electrodes in the display unit.

As a frequency component exceeding a prescribed frequency is removed from a drive signal waveform supplied to matrix electrodes of the display unit from a drive circuit, a drive signal selectively containing a frequency component below the prescribed frequency can be applied to the electrodes of the display unit, whereby the occurrence of a transient large current liable to occur at pixels close to the inlet ends of the electrodes can be effectively suppressed.

According to another aspect of the present invention, there is provided a display apparatus, comprising:

a display unit including electrodes arranged in a matrix form, and drive means for generating a rectangular signal waveform having a rising portion and a falling portion, superposing split pulses with the rising portion and the falling portion of the rectangular signal waveform and integrating the rectangular signal waveform superposed with the split pulses so as to provide a drive signal having moderately sloped rising and falling portions and supply the drive signal to inlet ends of the electrodes in the display unit.

According to a further aspect of the present invention, there is provided a liquid crystal display apparatus, comprising:

a liquid crystal display unit including waveforms arranged in a matrix form, and a liquid crystal disposed so as to form pixels in combination with the electrodes, rectangular signal waveform-generating means for generating a rectangular signal waveform having a rising portion and a falling portion, split pulse-generating means for generating split pulses, superposing means for superposing the split pulses with the rising and falling portions of the rectangular signal waveform, and integration means for integrating the rectangular signal waveform having rising an falling portions superposed with the split pulses, so as to provide a drive signal having moderately sloped rising and falling portions, and supply the drive signal to inlet ends of the electrodes in the display unit.

According to the present invention, the rectangular signal waveform having rising and falling portions is superposed with the split pulses and integrated by the integration means to remove a frequency component exceeding a cut-off frequency determined by a load capacitance and a resistance of each electrode from the rectangular signal waveform, thereby providing the drive signal having moderately sloped rising and falling portions. As a result, it becomes possible to suppress a transient large current flow to the electrodes of the display unit.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
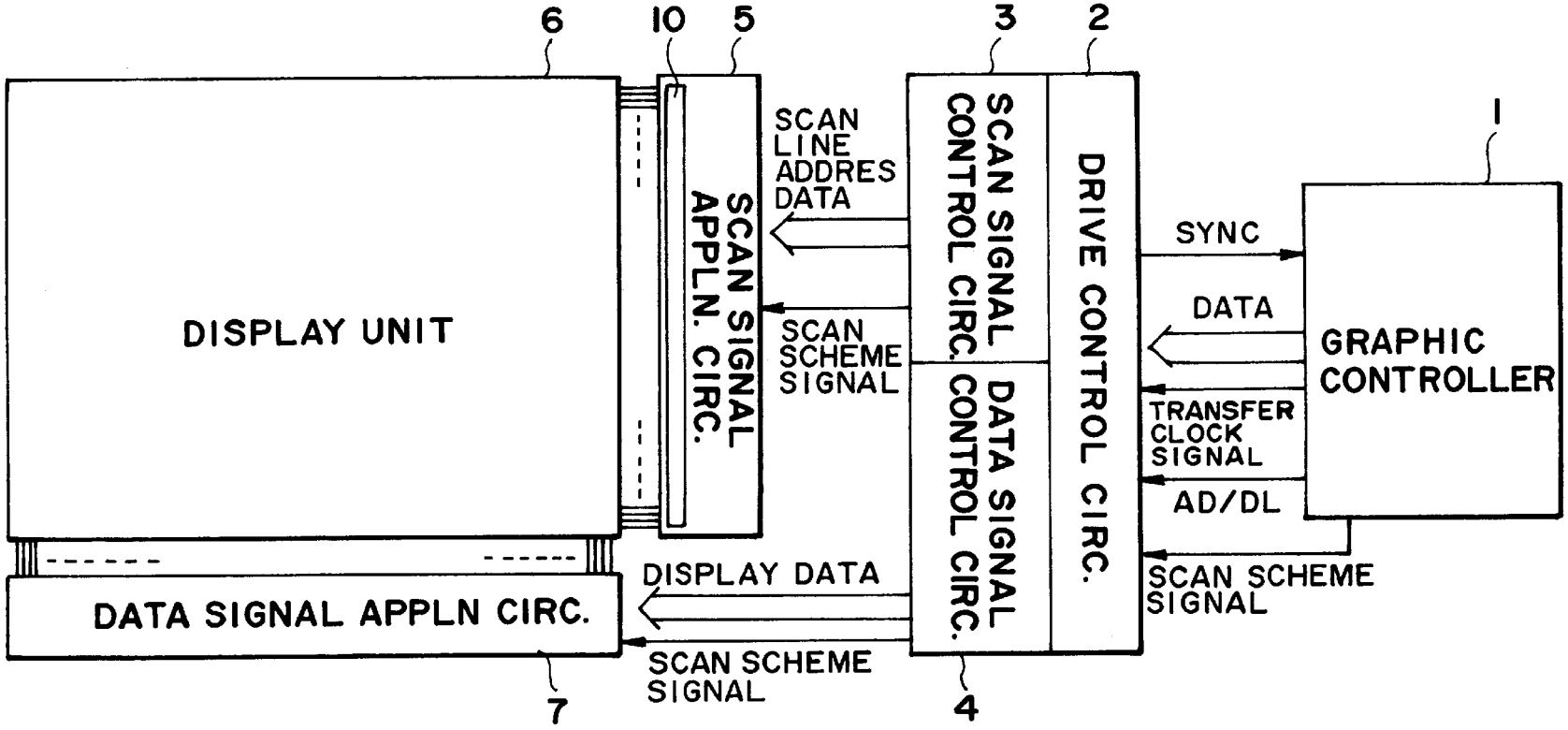
FIG. 1 is a block diagram of a display apparatus according to a first embodiment of the invention.
Figure 2:
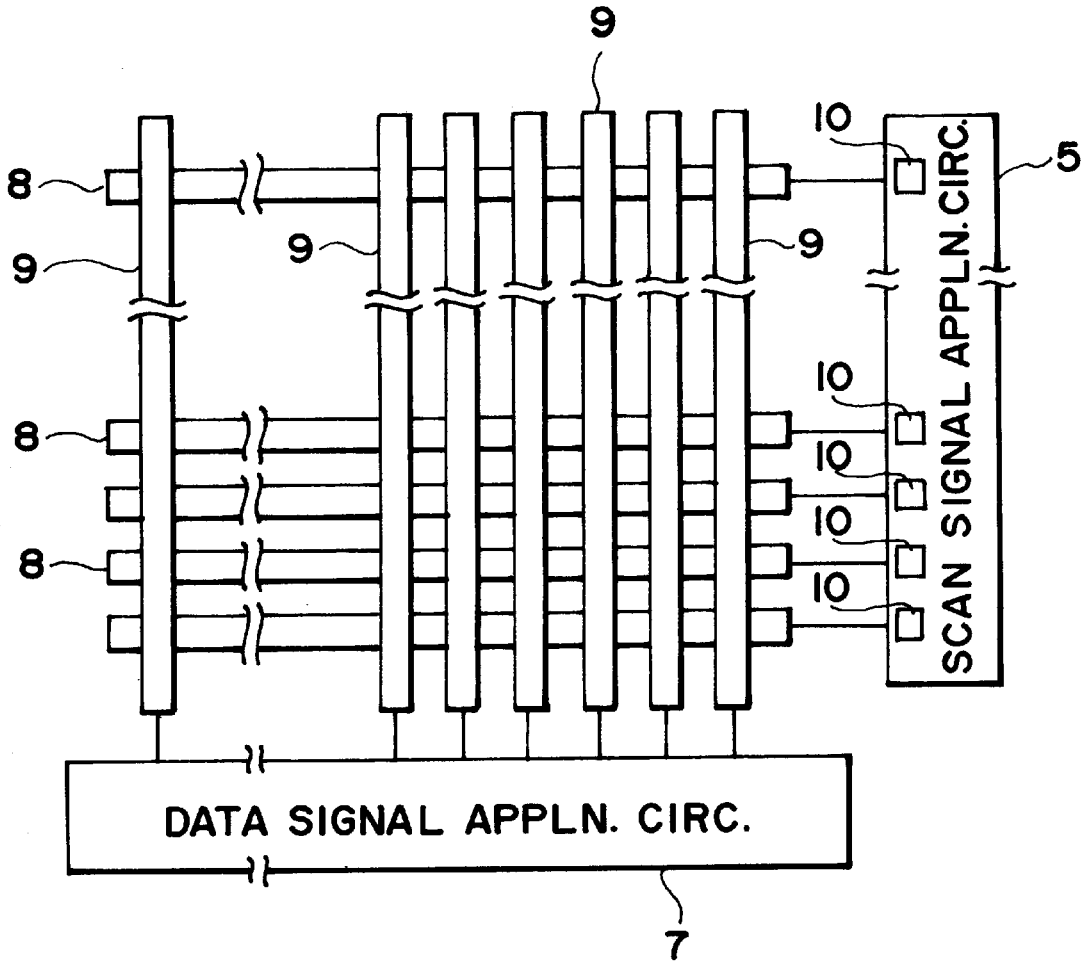
FIG. 2 is a schematic illustration of an arrangement around a display unit in the display apparatus of FIG. 1.

FIG. 1 is a block diagram of a liquid crystal display apparatus according to an embodiment of the present invention. Referring to FIG. 1, the display apparatus includes a graphic controller 1. Data supplied from the graphic controller 1 is sent via a drive control circuit 2 to a scanning signal control circuit 3 and a data signal control circuit 4, where the data is converted into scanning line address data and display data, respectively, which are inputted to a scanning signal application circuit 5 and a data signal application circuit 7, respectively, as a drive circuit. A drive control circuit 2 receives and supplies a synchronizing signal SYNC, a transfer clock signal, an address discriminating signal AD/DL, a scanning scheme signal, etc.

The scanning signal application circuit 5 receiving the scanning line address data generates a scanning selection signal and a scanning nonselection signal depending on the scanning line address data and supplies these signals to scanning electrodes of a liquid crystal display unit (liquid crystal display panel) 6. On the other hand, the data signal application circuit 7 receiving the display data generates data signals depending on the display data, and supplies the data signals to data electrodes of the liquid crystal display panel 6. Further, the scanning signal application circuit 5 includes a low-pass filter 10.

Herein, the liquid crystal display panel 6 comprises electrodes arranged in a matrix form including scanning electrodes 8 and data electrodes 9 so as a to effect an operation of displaying a picture depending on scanning selection signals and data signals respectively applied to these electrodes.

Then, a low-pass filter (integration circuit) used in the present invention will be described in further detail.

Figure 3:
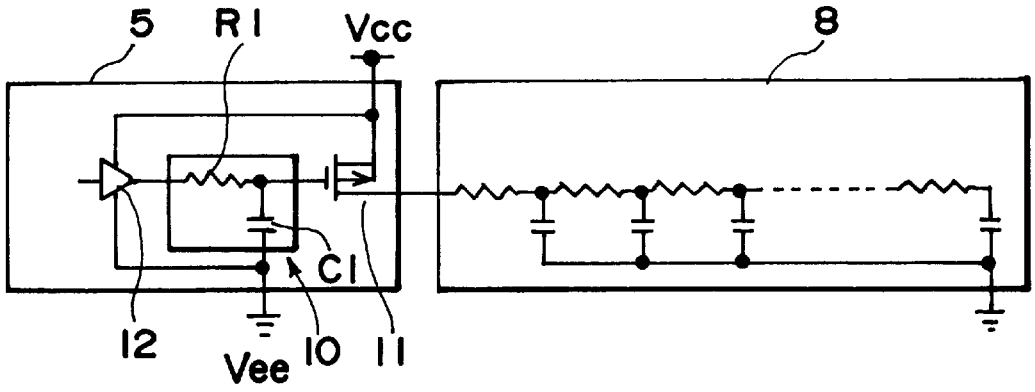
FIG. 3 is a circuit diagram of the display unit and drive circuit therefor including a low-pass filter according to an embodiment of the invention.

FIG. 3 illustrates a scanning signal application circuit 5 including a low-pass filter 10 and connected to an electrode 8 of a display panel.

Referring to FIG. 3, the scanning signal application circuit 5 includes an output buffer 11 comprising a p-channel-type MOS transistor, a pre-buffer 12, a high-potential first reference potential supply Vcc, and a low-potential second reference potential supply Vee.

A rectangular scanning signal outputted from a pre-buffer 12 is supplied via a low-pass filter 10 to an output buffer 11. The scanning signal having passed the low-pass filter 10 is caused to have a waveform from which a high-frequency component has been removed to have a moderately rising portion depending on a resistance R1 and a capacitance C1 constituting the low-pass filter 10. The scanning signal having a moderately rising pulse portion is supplied via the output buffer 11 to an input end of an electrode 8 in the display panel, whereby the occurrence of a transient current at pixels close to the inlet end of the electrode 8 is suppressed.

Such a low-pass filter can also or alternatively be provided as desired in a data signal-application circuit 7.

The embodiment shown in FIG. 3, incudes such a low-pass filter 10 within a scanning signal application circuit 5, particularly between buffers 11 and 12 so as to remove a high-frequency component exceeding a prescribed frequency (cut-off frequency) from a rectangular scanning selection signal waveform applied to an inlet end of a scanning electrode 8.

Figure 4:
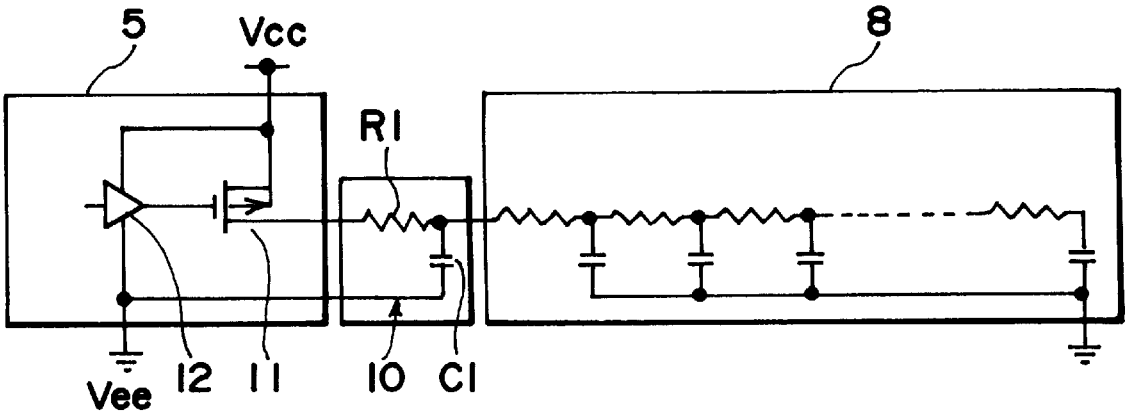
FIG. 4 is a circuit diagram of a display unit and a drive circuit therefor including a low-pass filter according to another embodiment of the invention.

Such a low-pass filter 10 can also be disposed outside a scanning signal application circuit 5 as shown in FIG. 4 instead of within a scanning signal application circuit 5. Thus, by disposing a low-pass filter 10 between an output buffer 11 and a scanning electrode 8 as shown in FIG. 4, it is also possible to remove a high-frequency component from a scanning selection signal waveform. In this case, a conventional scanning signal application circuit can be used as it is as the scanning signal application circuit 5.

In the embodiment shown in FIG. 4, in order to facilitate the connection of the scanning signal application circuit 5 and the low-pass filter 10 with electrodes 8 of a display panel, it is desirable to form the low-pass filter 10 integrally with the scanning signal application circuit 5 on a single IC chip.

In this way, by disposing a low-pass filter 10 together with a scanning signal application circuit 5 and/or a data signal application circuit 7 in a common IC chip, it becomes possible to simplify the drive circuit structure for the display apparatus and reduce the production steps therefor.

Further, by disposing such a low-pass filter 10 preceding the pre-buffer 12 of a scanning signal application circuit 5 and/or a data signal application circuit, it becomes possible to minimize the influence of a design change of the display panel per se and/or the circuit structure therefor. The drive signal waveform can be determined based on parameters of the scanning signal application circuit 5 and the data signal application circuit 7.

Instead of a combination of a resistance R1 and a capacitance C1 as shown in FIGS. 3 and 4, a low-pass filter can also be constituted as a combination of a coil and a capacitance, an active filter or switched capacitor filter for obtaining similar effects.

Further, such a low-pass filter 10 can be constituted as a combination of a parasitic resistance and a parasitic capacitance of an output terminal of an output buffer 11 by increasing the ON-resistance and the capacitance of the output terminal, if a corresponding enlargement of the area occupied by the output terminal of an output is tolerable in the IC.

The low-pass filter is designed to have a resistance and a capacitance, of which the values may be determined so as to remove a frequency component exceeding a cut-of frequency determined by the load capacitance and the resistance of a single electrode in a display panel.

More specifically, the low-pass filter is designed to have a cut-off frequency $f_f$ which is sufficient to remove a frequency component exceeding a cut-off frequency $f_p$ ($=\frac{1}{4}\pi RC$) determined by an electrode of a display panel, thus being designed to satisfy $f_f \geqq f_p$. Unlike a display panel (which is a distributed parameter circuit), a low-pass filter is a lumped parameter circuit and the cut-off frequency $f_f$ thereof is given as $1/(2\pi R_f C_f)$. Thus, $1/(2\pi R_f C_f)=1/(4\pi RC)$, $R_f C_f=2RC$.

Accordingly, $R_f$ and $C_f$ of the low-pass filter may be determined so as to satisfy $R_f C_f/RC \leqq 2$.

In actual designing of $R_f$ and $C_f$, these values may be determined so that $R_f C_f/RC$ can exceed 2 but should be at most ca. 2.88 in view of the fact that all the electrodes of a display panel do not have identical R and C values but these values vary to some extent.

Based on an equivalent circuit of an arbitrary scanning electrode, a single scanning electrode may be regarded as having a resistance Rt and a capacitance Ct given as:

$$Ct=h\times w\times \epsilon_0\times \epsilon/(Nc\times d),$$

wherein h: a vertical size of a panel display area, W: a horizontal size of the panel display area, Nc: a number of scanning electrodes, Ns: number of data electrodes, Rt: a scanning electrode resistance, Rs: a data electrode resistance, d: cell gap, $\epsilon_0$: permittivity and $\epsilon$: dielectric constant.

While it is necessary to solve a partial differential equation in order to determine an exact characteristic of a distributed parameter circuit, it is possible to obtain a good approximation based on (Ct/10)=C and (Rt/10)=R as a solution of a 10-step ladder network. Accordingly, the above-described impedance $Z_0$ and transfer ratio A can be calculated as:

$$Z_0 = \frac{Rt/10}{2} + \sqrt{\frac{(Rt/10)^2}{4} + \frac{Rt/10}{2\pi f Ct/10}}$$

$$A = 1 - \frac{Rt/10}{\frac{Rt/10}{2} + \sqrt{\frac{(Rt/10^2)}{4} + \frac{Rt/10}{2\pi f Ct/10}}}$$

When a 15-inches XGA display panel is taken as a specific example, the above-raised parameters are given as follows:

h=230 mm, w=300 mm, Nc=768,

Rt=2 k-ohm, Rs=8 k-ohm, d=1.5 $\mu$m, $\epsilon_0$=8.855 $e^{-12}$, $\epsilon$=3.5

From the above parameters, the cut-off frequency $f_p$ is calculated as follows:

$$f_p=1/[4\pi(Rt/10)\times(Ct/10)]=\text{ca. } 2e^6.$$

From the above-mentioned relationship, the cut-off frequency $f_f$ of the low-pass filter may be related as follows:

$f_f=1/(2\pi R_f C_f) \leqq f_p=$ca. $2e^6$.

Accordingly, the parameters $R_f$ and $C_f$ of the low-pass filter may be given, for example, as follows.

$R_f=1500$ ohm, and $C_f=53$ pF.

Figure 13:
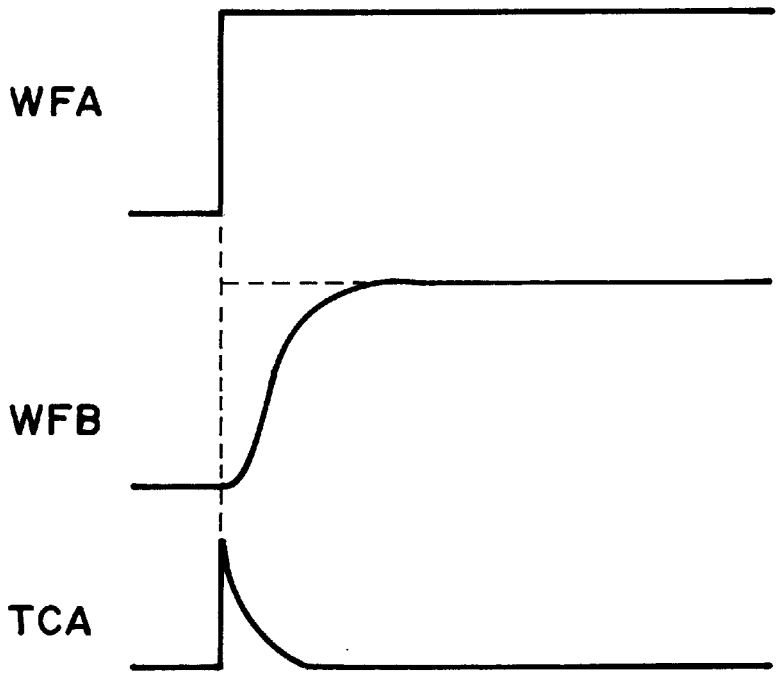
FIG. 13 is a waveform diagram showing drive signal waveforms and a transient current.
Figure 14:
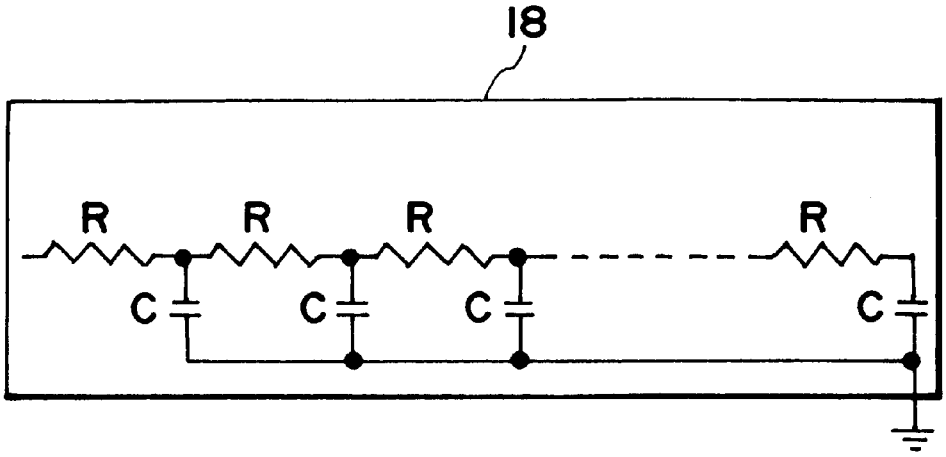
FIG. 14 is an equivalent circuit diagram of an electrode in a display unit.
Figure 15:
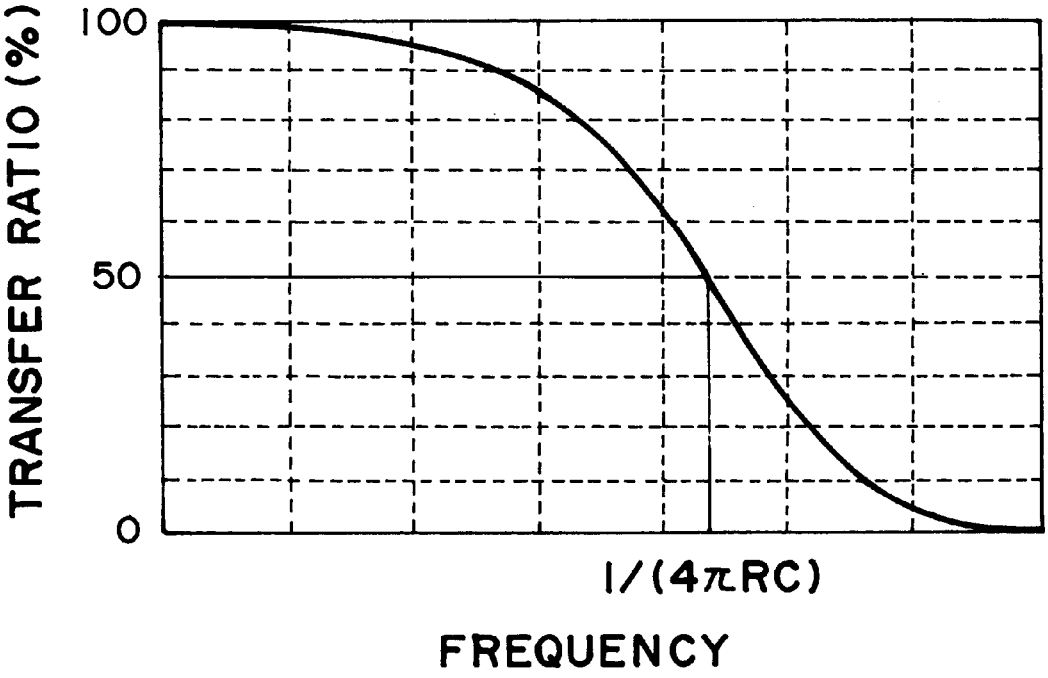
FIG. 15 is a graph showing a frequency characteristic of transfer ratio.

By removing a high-frequency component as described above from a scanning signal waveform, not a rectangular waveform as shown at WFA in FIG. 13 but a non- or sub-rectangular waveform similar to the one shown at WFB in FIG. 13 having only frequency components below a prescribed frequency is applied to a drive circuit-side end (i.e., an input end) of a scanning electrode 8. As a result, it is possible to prevent the occurrence of a large transient current at the time of electrode drive, thus suppressing changes of power supply potential and ground potential, occurrence of radiation noise, heat-generation from the liquid crystal display unit and increase in consumption current of a liquid crystal apparatus.

Figure 5:
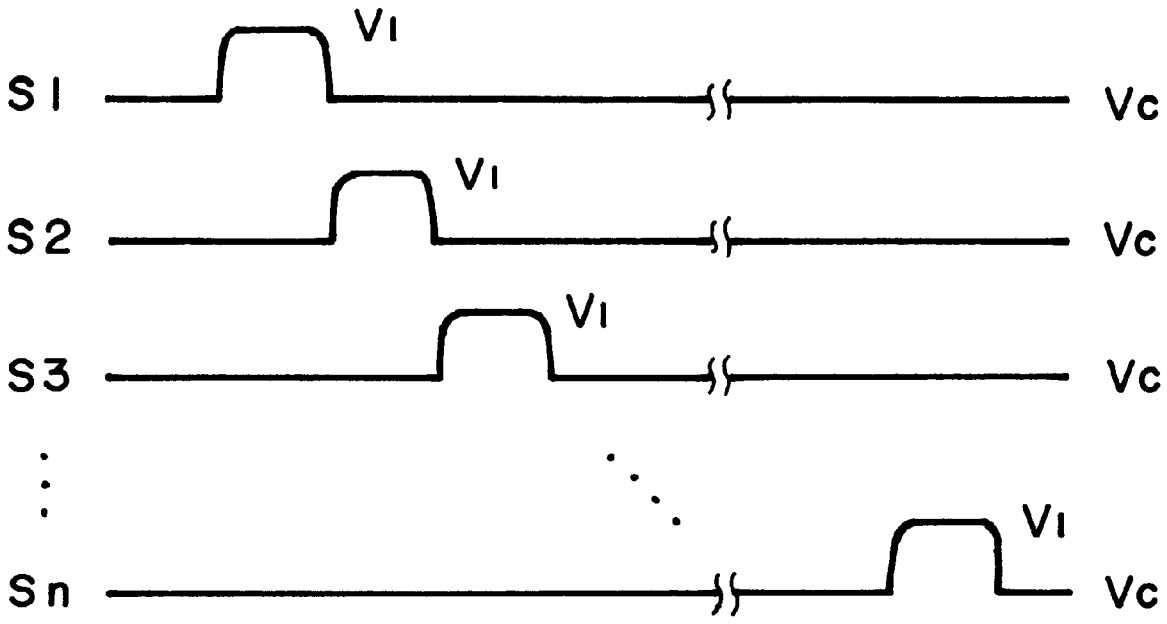
FIG. 5 is a waveform diagram showing a set of drive signal waveforms used in the invention.

FIG. 5 is a waveform diagram showing a succession of scanning signal waveforms as drive signal waveforms used in the present invention. At S1, S2, S3, . . . Sn are shown scanning signal waveforms time-serially applied to input ends of respective scanning electrodes. Each scanning electrode is supplied with a scanning non-selection signal having a voltage value Vc, and a scanning selection signal having a voltage value $V_1$ and having moderately rising and falling portions.

Another embodiment of the present invention will be further described with reference to drawings.

Figure 6:
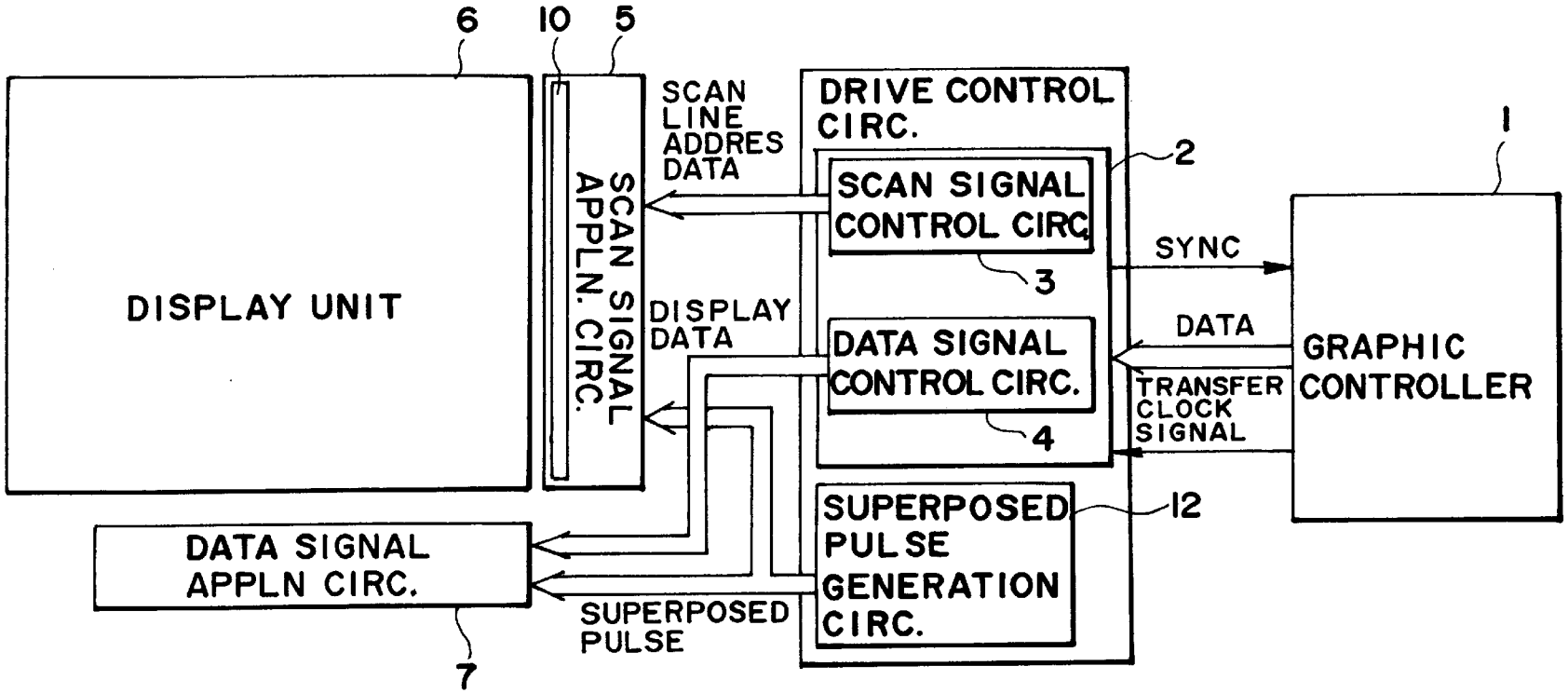
FIG. 6 is a block diagram of a display apparatus according to another embodiment of the invention.

FIG. 6 is a block diagram of a liquid crystal apparatus according to such another embodiment of the present invention.

Referring to FIG. 6, the liquid crystal apparatus includes a graphic controller 1, from which data is supplied via a drive control circuit 2 to a scanning signal control circuit 3 and a data signal control circuit 4, where the data is converted into scanning line address data and display data, respectively, which are inputted to a scanning signal application circuit 5 and a data signal application circuit 7, respectively, as a drive circuit. A drive control circuit 2 receives and supplies a synchronizing signal SYNC, a transfer clock signal, etc.

The scanning signal application circuit 5 receiving the scanning line address data generates a scanning selection signal and a scanning nonselection signal depending on the scanning line address data and supplies these signals to scanning electrodes of a liquid crystal display panel 6. On the other hand, the data signal application circuit 7 receiving the display data generates data signals depending on the display data, and supplies the data signals to data electrodes of the liquid crystal display panel 6. Further, the scanning signal application circuit 5 includes a low-pass filter 10. The display apparatus further includes a superposed pulse generation circuit 12 as a superposed pulse generating means described hereinafter.

Herein, the liquid crystal display panel 6 comprises electrodes arranged in a matrix form including scanning electrodes 8 and data electrodes 9 so as to effect an operation of displaying a picture depending on scanning selection signals and data signals respectively applied to these electrodes.

In this embodiment, between the scanning electrodes 8 and the scanning signal application circuit 5 (and possibly also between the display electrodes 8 and the data signal application circuit), a drive circuit 11 including a NAND gate 13 and an output buffer 14, and an integration circuit (low-pass filter) 12 formed of the ON resistance and the electrode resistance C of the output buffer 14.

The NAND gate 13 in the drive circuit 11 functions to superpose a scanning signal supplied via one line 15 and a superposed pulse signal supplied via another line 16 from a superposed pulse generation circuit 12. The resultant superposed signal is inputted to the gate of the output buffer 14.

Figure 8:
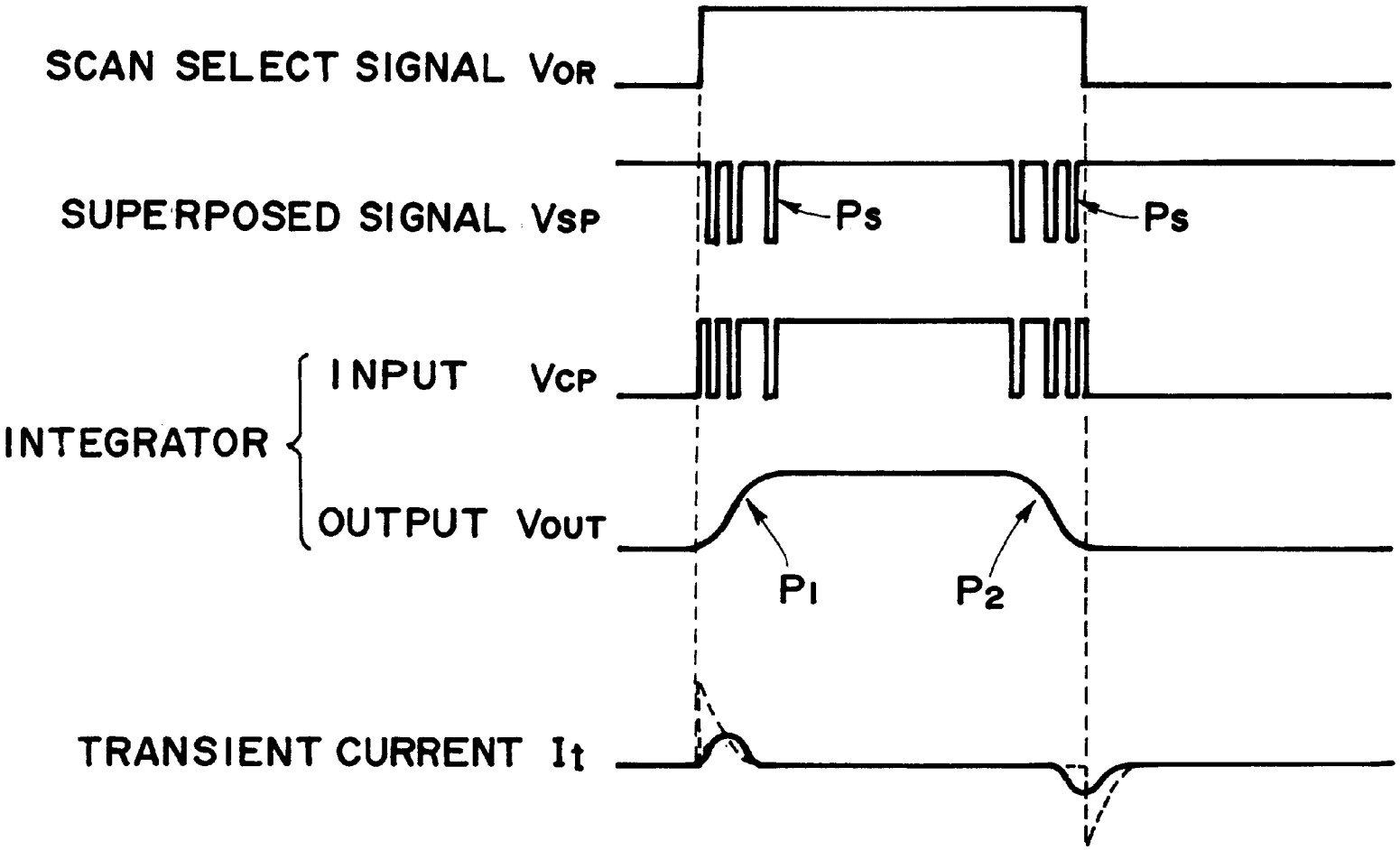
FIG. 8 is a waveform diagram showing a set of signal waveforms supplied by the drive circuit and input and output signal waveforms of an integration circuit.

FIG. 8 shows input and output waveforms at the drive circuit 11 and the low-pass filter 10. A scanning selection signal $V_{OR}$ supplied via the line 15 to the NAND gate 13 is a rectangular signal having steep rising and falling portions and including a high-frequency component. A superposed pulse $V_{SP}$ supplied from the superposed signal generation circuit 12 via the line 16 is a signal comprising split signals or thinned pulses $R_S$ at portions corresponding to the rising and falling portions of the scanning selection signal.

Figure 7:
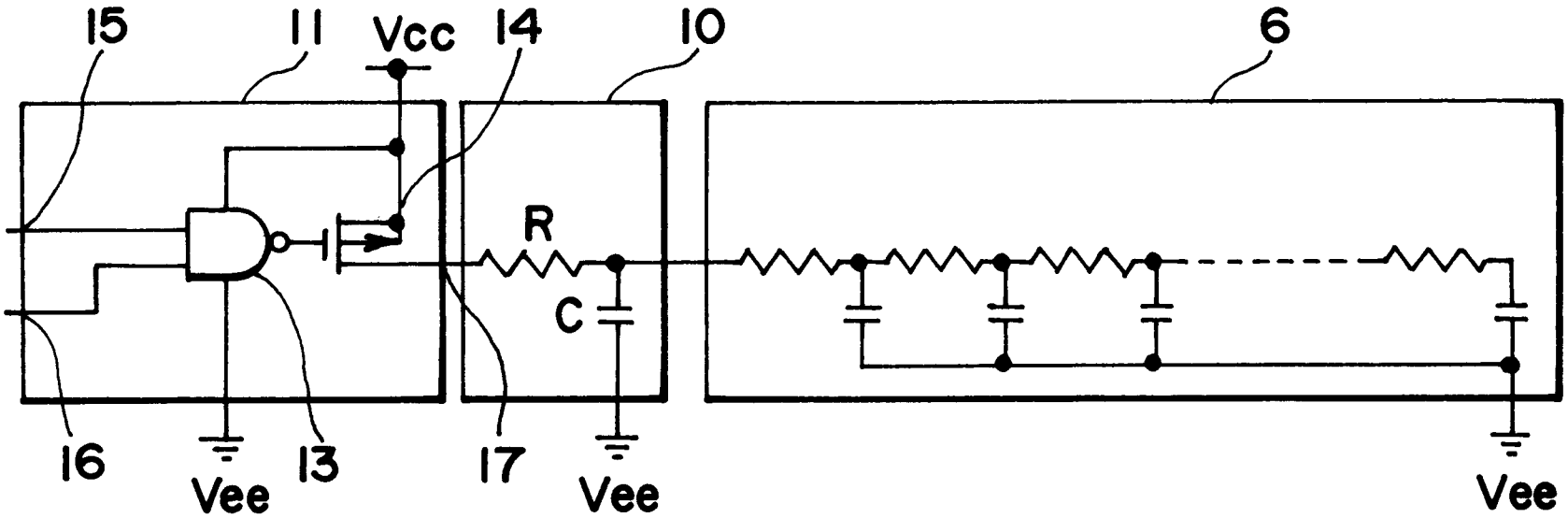
FIG. 7 is a circuit diagram of a display unit and a drive circuit therefor including a low-pass filter in the display apparatus shown in FIG. 6.

The scanning selection signal and the superposed pulse are superposed at the NAND gate 13 to provide an input signal waveform as shown at $V_{CP}$, which is then inputted to the low-pass filter 10. The input signal waveform to the integration 10 has rising and falling portions formed by superposition with thinned pulses Ps, which are comb-shaped as shown at $V_{Cp}$ in FIG. 8. When the signal waveform is inputted as shown in FIG. 7 via an input line 17 to the low-pass filter 10, the waveform is integrated by the low-pass filter 10 to remove a high-frequency component therein, thereby providing a sub-rectangular scanning selection signal Vout having a rising portion $P_1$ and a falling portion $P_2$ which are both moderately sloped.

Then by supplying such a sub-rectangular scanning selection signal having moderately sloped rising and falling portions $P_1$ and $P_2$ to an input end of a scanning electrode, it becomes possible to prevent or alleviate the occurrence of a large transient current, a change of ground potential, and occurrence of a radiation noise, at the time of rising and falling of the scanning selection signal, heat-generation and power consumption at the liquid crystal display panel.

The rising time and the falling time of a scanning selection signal can be controlled by controlling the number of thinned pulses Ps and therefore can be easily adjusted to a change in cut-off frequency of the liquid crystal display panel due to a fluctuation during production of the liquid crystal display panel.

Figure 9:
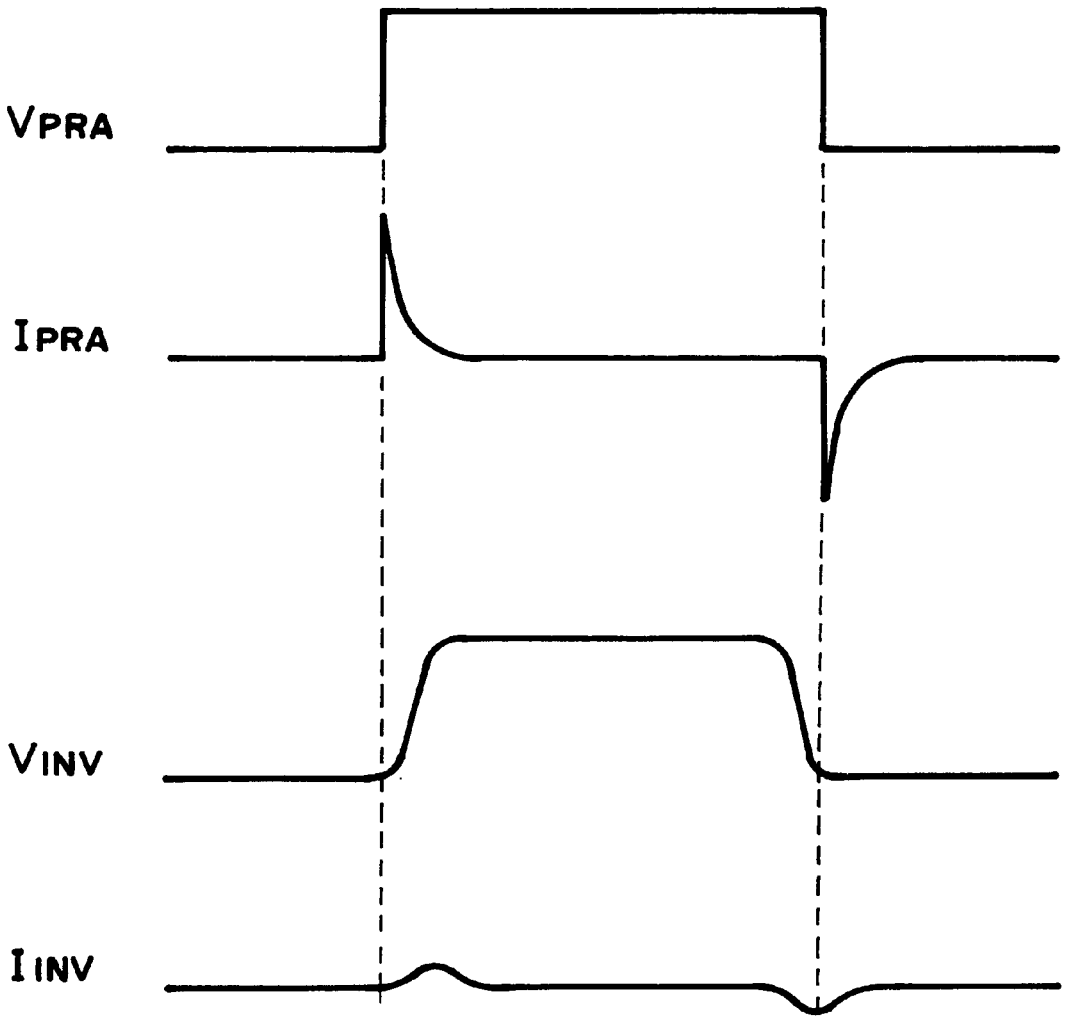
FIG. 9 is a waveform diagram showing a relationship between drive signals and a transient current.

In short, as a rectangular wave as shown at $V_{PRA}$ in FIG. 9 has been conventionally applied to input ends of electrodes in a display panel, a large transient current as shown at $I_{PRA}$ has been flowed at pixels close to such an electrode inlet end. In contrast thereto, according to the present invention, a sub-rectangular wave signal is applied to input ends of electrodes in a display panel, so that the transient current flowing at pixels close to such an electrode inlet end can be suppressed to an extent as shown at $I_{INV}$ in FIG. 9.

Figure 10:
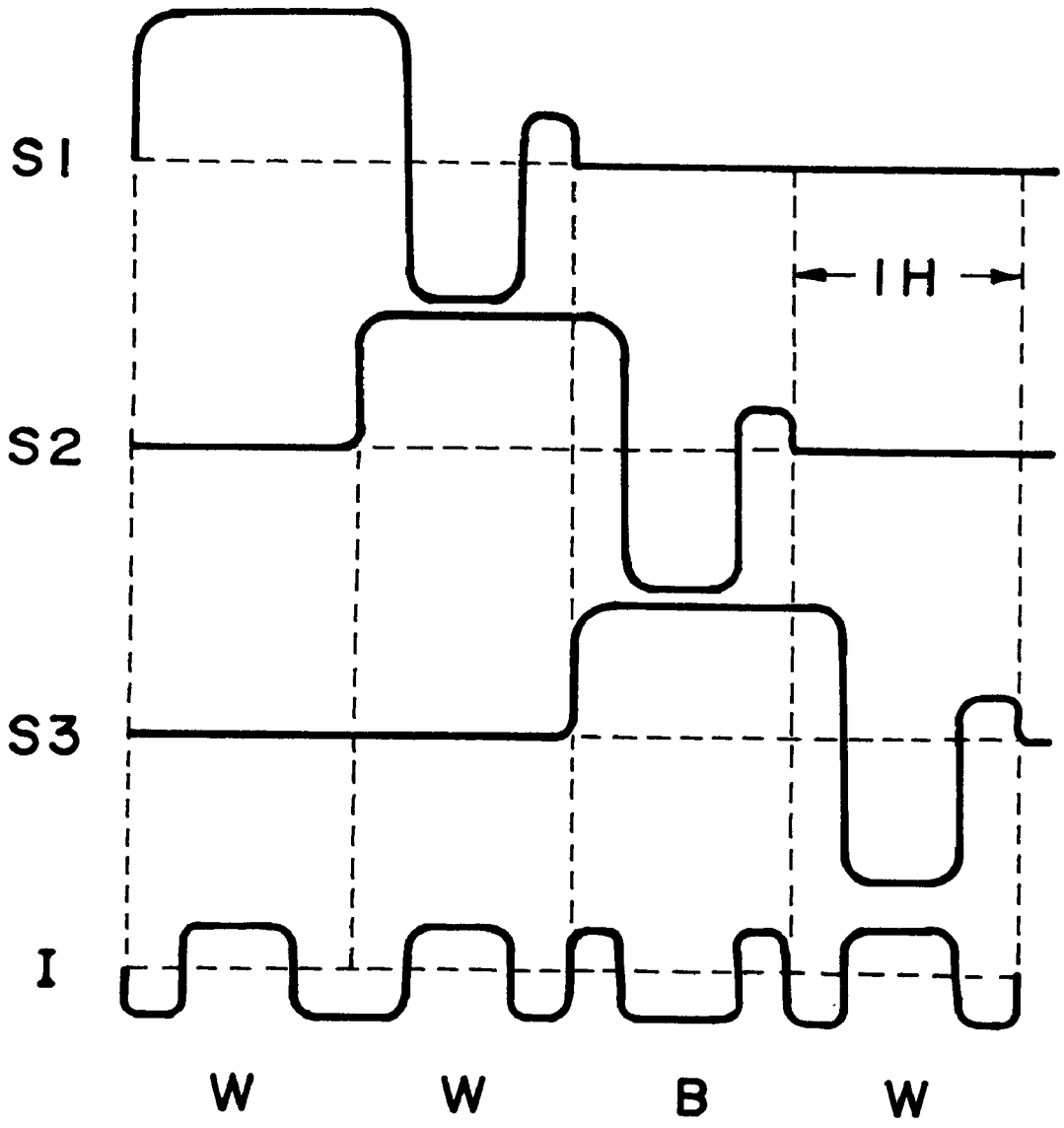
FIG. 10 is a waveform diagram showing another set of drive signal waveforms used in the invention.
Figure 11:
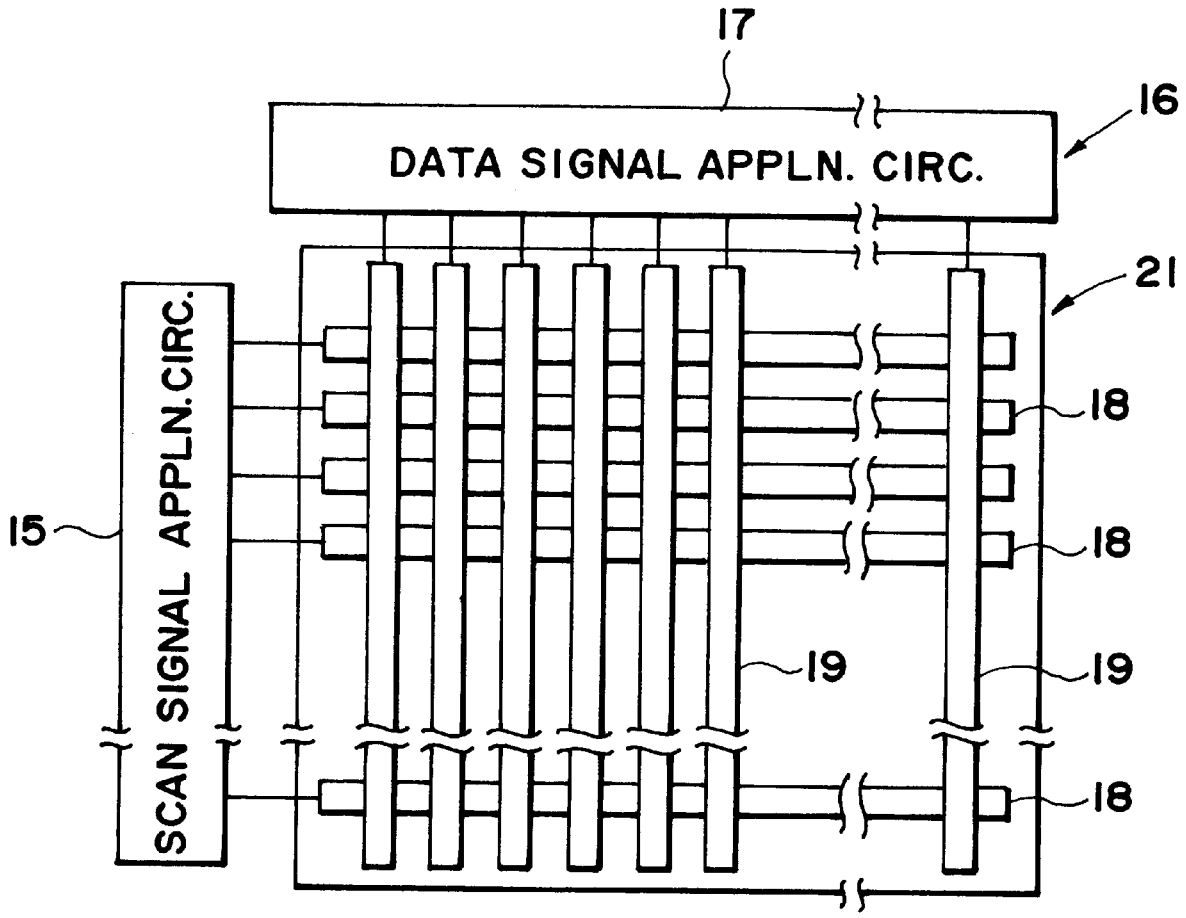
FIG. 11 PRIOR ART
FIG. 11 is a schematic plan view of an arrangement around a display unit in a conventional display apparatus.
Figure 12:
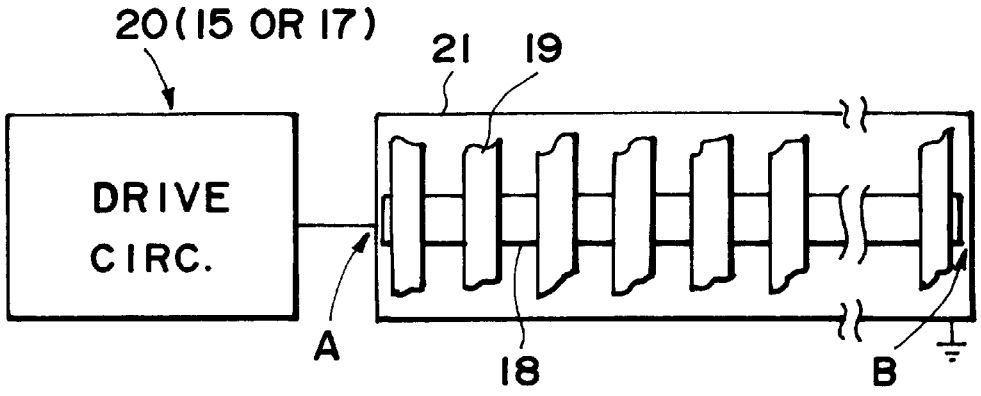
FIG. 12 PRIOR ART
FIG. 12 is a view illustrating a combination of a display unit and a drive circuit therefor in a conventional display apparatus.

FIG. 10 shows a set of drive signal waveforms suitably applied to a liquid crystal display panel formed by disposing a ferroelectric chiral smectic liquid crystal between a pair of substrates.

Such a ferroelectric liquid crystal display panel is actually composed of 1024 or more scanning electrodes and 1280 or more display electrodes for each of R, G and B colors, but FIG. 10 shows only scanning signals applied sequentially to three scanning electrodes and data signals (for displaying W (white) and B (black)) applied to one display electrode.

As described above, according to the present invention, by disposing a low-pass filter between a drive signal source and a liquid crystal display unit (within or outside a drive circuit for the liquid crystal display unit), it becomes possible to remove a high-frequency component from a drive signal waveform applied to the liquid crystal display unit. As a result, it becomes possible to prevent a transient large current from flowing at the time of driving the liquid crystal by supplying signals to the electrodes, thereby remarkably alleviating the change in power supply potential or ground potential, occurrence of radiation noise, heat-generation and increase in power consumption at the liquid crystal display unit in the display apparatus.

Further by superposing split pulses to a rising portion and a falling portion of a drive signal waveform and integrating the drive signal waveform superposed with split pulses, it becomes possible to easily generate a sub-rectangular drive signal waveform from which a high-frequency component has been removed.

What is claimed is:

1. A display apparatus, comprising:

a display panel having a display area (h×w) and cell gap (d) and including electrodes arranged in a matrix form and comprising a number (Nc) of scanning electrodes each having a resistance (Rt) and a capacitance (Ct), and a number of data electrodes;

a circuit for generating a rectangular drive signal waveform supplied to the scanning electrodes and a data signal waveform supplied to the data electrodes, respectively, of the display panel; and a low-pass filter for recovering a frequency component exceeding a prescribed cut-off frequency (f) from the rectangular drive signal waveform to form a resultant drive signal waveform that is generally rectangular but with moderately sloped rising and falling portions, and applying the resultant drive signal waveform to inlet ends of the scanning electrodes in the display panel, wherein said cut-off frequency (f) is prescribed according to the following formula:

$$f=1/(4\pi(Rt/10)\times(Ct/10)),$$

wherein Rt denotes a scanning electrode resistance, and Ct denotes a scanning electrode capacitance determined according to the following formula:

$$Ct=h\times w\times\epsilon o\times\epsilon/(Nc\times d),$$

wherein h denotes a vertical size of the panel display area; w, a horizontal size of the panel display area; Nc, the number of the scanning electrodes; d, the cell gap; $\epsilon o$, a permittivity: and $\epsilon$, a dielectric constant.

2. A display apparatus according to claim 1, wherein the low-pass filter is disposed between the circuit and the electrodes of the display unit.

3. A display apparatus according to claim 1, wherein said low-pass filter is integrated within the circuit.

4. A display apparatus according to claim 1, further including a buffer for treating the resultant drive signal waveform from the low-pass filter before supplying the resultant drive signal waveform to the inlet ends of the electrodes.

5. A display apparatus according to claim 1, wherein said display unit is a liquid crystal display unit.

6. A liquid crystal display apparatus comprising:

a liquid crystal display panel having a display area (h×w) and a cell gap (a), and including electrodes arranged in a matrix form, and a liquid crystal disposed in the cell gap so as to form pixels in combination with the electrodes, the electrodes arranged in a matrix form comprising a number (Nc) of scanning electrodes each having a resistance (Rt) and a capacitance (Ct), and a number of data electrodes;

signal waveform-generating means for generating a signal waveform supplied to the scanning electrodes and the data electrodes, said signal waveform-generating means including rectangular signal waveform-generating means for generating a rectangular drive signal waveform having a rising portion and a falling portion supplied to the scanning electrodes;

split pulse-generating means for generating split pulses including a frequency component exceeding a prescribed cut-off frequency (f);

superposing means for superposing the split pulses with the rising and falling portions of the signal waveform; and integration means for integrating the signal waveform having rising and falling portions superposed with the split pulses, so as to provide a resultant drive signal having moderately sloped rising and falling portions by removing a frequency component exceeding the prescribed cut-off frequency (f) from the signal waveform, and to apply the resultant drive signal to inlet ends of the scanning electrodes in the display panel, wherein said cut-off frequency (f) is prescribed according to the following formula:

$$f=1/(4\pi(Rt/10)\times(Ct/10)),$$

wherein Rt denotes a scanning electrode resistance, and Ct denotes a scanning electrode capacitance determined according to the following formula:

$$Ct=h\times w\times\epsilon o\times\epsilon/(Nc\times d),$$

wherein h denotes a vertical size of the panel display area; w, a horizontal size of the panel display area; Nc, the number of the scanning electrodes; d, the cell gap; $\epsilon o$, a permittivity; and $\epsilon$, a dielectric constant.

* * * * *

UNITED STATES PATENT AND TRADEMARK OFFICE

CERTIFICATE OF CORRECTION

PATENT NO. : 6,295,042 B1
DATED : September 25, 2001
INVENTOR(S) : Tadashi Aoki

It is certified that error appears in the above-identified patent and that said Letters Patent is hereby corrected as shown below:

Column 6,
Line 8, "cut-of" should read -- cut-off --.

Signed and Sealed this

Ninth Day of April, 2002

*Attest:*

*Attesting Officer*

JAMES E. ROGAN
*Director of the United States Patent and Trademark Office*